US009145710B2

(12) United States Patent
Weinerman et al.

(10) Patent No.: US 9,145,710 B2
(45) Date of Patent: Sep. 29, 2015

(54) LATCH ASSEMBLY

(75) Inventors: Lee S. Weinerman, Medina, OH (US); Grant A. Lugas, Elyria, OH (US); David J. Schlosser, Dover, OH (US)

(73) Assignee: The Eastern Company, Cleveland, OH (US)

( * ) Notice: Subject to any disclaimer, the term of this patent is extended or adjusted under 35 U.S.C. 154(b) by 395 days.

(21) Appl. No.: 13/563,924

(22) Filed: Aug. 1, 2012

(65) Prior Publication Data

US 2014/0035293 A1 Feb. 6, 2014

(51) Int. Cl.

| | |
|---|---|
| ***E05C 3/02*** | (2006.01) |
| ***E05B 15/10*** | (2006.01) |
| ***E05B 85/24*** | (2014.01) |
| ***E05B 85/26*** | (2014.01) |
| ***E05C 3/24*** | (2006.01) |
| ***E05C 3/30*** | (2006.01) |
| *E05C 3/12* | (2006.01) |

(52) U.S. Cl.

CPC ..... *E05B 15/102* (2013.01); *E05B 15/10* (2013.01); *E05B 85/243* (2013.01); *E05B 85/26* (2013.01); *E05C 3/24* (2013.01); *E05C 3/30* (2013.01); *Y10T 292/0945* (2015.04); *Y10T 292/1052* (2015.04); *Y10T 292/1075* (2015.04); *Y10T 292/1083* (2015.04)

(58) Field of Classification Search

CPC ..... E05B 85/243; E05B 85/26; E05C 3/24
USPC ..... 292/99, 194, 213, 214, 216, 217, 219, 292/220, 96

See application file for complete search history.

(56) References Cited

U.S. PATENT DOCUMENTS

| | | | | | |
|---|---|---|---|---|---|
| 591,396 | A | * | 10/1897 | Fleming | 292/99 |
| 1,904,291 | A | * | 4/1933 | Neilson et al. | 292/67 |
| 2,210,495 | A | * | 8/1940 | North | 292/123 |
| 2,296,988 | A | * | 9/1942 | Endter | 292/214 |
| 2,567,114 | A | * | 9/1951 | Linn | 244/102 SL |
| 2,634,147 | A | * | 4/1953 | Robertson | 292/216 |
| 2,693,976 | A | * | 11/1954 | Bontempo | 292/216 |
| 2,736,596 | A | * | 2/1956 | Burke | 292/332 |
| 2,789,023 | A | * | 4/1957 | Johnson | 312/291 |
| 2,872,241 | A | * | 2/1959 | Shelden | 296/68.1 |
| 2,881,021 | A | * | 4/1959 | Jacobson | 292/229 |
| 3,087,749 | A | * | 4/1963 | Capton | 292/99 |
| 3,423,118 | A | * | 1/1969 | Waldo | 292/229 |
| 3,492,036 | A | * | 1/1970 | Young | 292/213 |
| 3,576,337 | A | * | 4/1971 | Gudde | 292/201 |
| 3,600,023 | A | * | 8/1971 | Gudde | 292/201 |
| 3,652,113 | A | * | 3/1972 | Odend'hal et al. | 292/216 |
| 3,666,305 | A | * | 5/1972 | Schlichter | 292/48 |
| 3,667,793 | A | * | 6/1972 | Varrin et al. | 292/216 |

(Continued)

*Primary Examiner* — Carlos Lugo
(74) *Attorney, Agent, or Firm* — Ralph E. Jocke; Walker & Jocke

(57) ABSTRACT

A latch assembly is provided that includes a housing. The latch assembly also includes a latch in rotatable connection with the housing at a first axis. The latch assembly also includes a drive lug in rotatable connection with the housing at a second axis, wherein the first axis is spaced apart from the second axis on the housing. Rotation of the drive lug in a first rotational direction responsive to a striker acting on a first portion of the drive lug is operative to cause the latch to rotate in the same first rotational direction as the drive lug, such that a first portion of the latch moves in transverse relation relative to the striker to a position in which the striker extends between the first portion of the drive lug and the first portion of the latch.

20 Claims, 18 Drawing Sheets

(56) References Cited

U.S. PATENT DOCUMENTS

| | | | | | |
|---|---|---|---|---|---|
| 3,844,593 | A | * | 10/1974 | Slattery | 292/48 |
| 4,036,517 | A | * | 7/1977 | Talmadge | 292/216 |
| 4,545,606 | A | * | 10/1985 | Vodra | 292/92 |
| 4,573,333 | A | * | 3/1986 | Choi | 70/279.1 |
| H358 | H | * | 11/1987 | Kaveney, Jr. | 292/216 |
| 4,835,997 | A | * | 6/1989 | Akright | 70/141 |
| 4,896,906 | A | | 1/1990 | Weinerman et al. | |
| 4,911,487 | A | * | 3/1990 | Rachocki | 292/216 |
| 5,127,686 | A | * | 7/1992 | Gleason et al. | 292/216 |
| 6,651,467 | B1 | * | 11/2003 | Weinerman et al. | 70/208 |
| 7,140,649 | B1 | * | 11/2006 | Gregory | 292/48 |
| 7,722,096 | B2 | * | 5/2010 | Arlinghaus et al. | 292/92 |
| 7,832,777 | B2 | * | 11/2010 | Banks et al. | 292/92 |
| 7,959,195 | B2 | * | 6/2011 | Harvey et al. | 292/201 |
| 7,980,603 | B2 | * | 7/2011 | Peabody et al. | 292/137 |

* cited by examiner

LATCH ASSEMBLY

BACKGROUND

Latch assemblies are mechanical apparatuses that are typically used to releasably hold two elements in closed relation. Such elements for example may include a closure member and a body member. For example, latch assemblies may be used to releasably hold a closure member such as a door or hatch in a closed position relative to a body member such as a door frame or hatch frame.

Latch assemblies may benefit from improvements.

SUMMARY

The following is a brief summary of subject matter that is described in greater detail herein. This summary is not intended to be limiting as to the scope of the claims.

In one example embodiment of one or more inventions described herein, a latch assembly may include a housing operative to hold together one or more elements that comprise the latch assembly. Such elements may include a latch in rotatable connection with the housing at a first axis. Such elements may also include a drive lug in rotatable connection with the housing at a second axis. The first axis may be spaced apart from the second axis on the housing. Such first and second axes may also be substantially parallel (e.g., the first axis is parallel with the second axis and/or deviates less than 5 degrees from being parallel with respect to the second axis).

In this described embodiment, the latch may include a first portion that is operable to extend in a first area of the latch assembly (e.g., an area such as an end of the housing that does not extend between the first and second axis). In addition, the drive lug may include a first portion that extends in the same first area of the latch assembly.

In this described example embodiment, the latch assembly may be mounted to a closure member such as a door or hatch that is operative to move between an open and closed position relative to a body member such as a door frame or hatch frame. Also, in this described example embodiment, the body member may include a striker (e.g., a strike plate, shaft, bar, rode, or other strike element) that is positioned to strike the drive lug of the latch assembly when the closure member is moved from the open position to the closed position. Also in this described example embodiment, when the closure member (e.g., door, hatch) is moved to a closed position and thus moves relative to the striker, the drive lug is operative to rotate in a first rotational direction (relative to the housing) responsive to the striker acting on (i.e., striking and relatively pushing) the first portion of the drive lug.

In this described example embodiment, the drive lug and latch are configured such that rotation of the drive lug in the first rotational direction responsive to the striker acting on the first portion of the drive lug is operative to cause the latch to rotate in the same first rotational direction as the drive lug. Also, the latch is configured such that when it moves in the first rotational direction, the first portion of the latch moves in transverse relation relative to the striker to a position in which the striker extends between the first portion of the drive lug and the first portion of the latch. In this manner, the operation of closing the closure member is operative to actuate the latch assembly and cause the latch and drive lug to extend on either side of the striker and thereby prevent the closure member from moving from the closed position to the open position.

In order to selectively hold the latch in place adjacent a side of the striker, the latch assembly may include a release paw. The release paw may be in rotatable connection with the housing at a third axis that is spaced part on the housing from the first and second axes. In a first rotational position, the release paw may engage a portion of the latch, which prevents the latch from rotating away from the striker. In a second rotational position, the release paw is operative to permit the latch to rotate away from the striker, and thereby enable the closure member to move to the open position.

Other aspects will be appreciated upon reading and understanding the attached figures and description.

DETAILED DESCRIPTION

Figure 1:
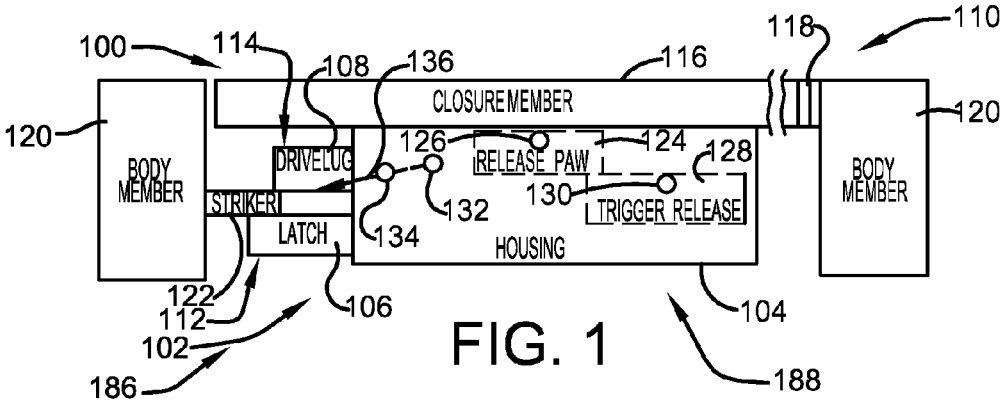
FIGS. 1-3 are functional block diagrams of an example apparatus in which an example latch assembly is mounted to a closure element orientated in a closed position.

Various technologies pertaining to latch assemblies will now be described with reference to the drawings, where like reference numerals represent like elements throughout. In addition, several diagrams of example systems are illustrated and described herein for purposes of explanation; however, it is to be understood that functionality that is described as being carried out by certain system components may be performed by multiple components. Similarly, for instance, a component may be configured to perform functionality that is described as being carried out by multiple components.

With reference to FIG. 1, an example functional block diagram of an apparatus 110 that facilitates releasably holding two elements in closed relation is illustrated. The apparatus 110 comprises a latch assembly 102. The latch assembly includes a housing 104, a latch 106, and a drive lug 108. In this described example, the latch 106 is in rotatable connection with the housing at a first axis 132. Also, the drive lug 108 is in rotatable connection with the housing at a second axis 134. As illustrated in FIG. 1, the first axis 132 is spaced apart from the second axis on the housing. Because FIG. 1 is directed to a functional block diagram, the shapes of the latch and the drive lug are only depicted in block form extending from the housing 104. Example embodiments of various shapes, movements, and mountings of the latch and drive lug are described in more detail below in FIGS. 4-21.

As illustrated in FIG. 1, the latch assembly is typically mounted to a closure member 116 such as a door, a hatch, a hood, a trunk, and/or a lid. Such a closure element is typically installed in rotating connection with one or more hinges 118 with a body member 120. Such a body member 120 may correspond to a mounting surface, door frame, hatch frame, enclosure, and or any other type of structure that bounds an opening that is closable via the closure element 116. Such a body member 120 may extend on opposite sides of the closure member and may include mounted thereto (and/or formed integral therewith) a striker 122.

As shown in FIG. 1, the latch and drive lug include respective first portions 112, 114 which are operative to extend outwardly of the housing 104 so as to extend on either side of the striker 122. In this orientation, the position of the striker 455 between the first portion 112 of the latch 106 and the first portion 114 of the drive lug 108 is operative to prevent the closure member 116 from moving out of a closed position (as shown in FIG. 1) relative to the body member 120 into an open position 200 (as shown in FIG. 2).

To keep the latch 106 in the position shown in FIG. 1, the latch assembly 102 may include a release paw 124 which is in rotatable connection with the housing at a third axis 126. Such a release paw 124 may be operative to engage with the latch so as to prevent rotation of the first portion 112 of the latch away from the striker 122. In addition, the latch assembly 102 may include a trigger release 128. Movement of the trigger release 128 is operative to cause the release paw 126 to also move so as to permit the latch to move away from the striker 122. In an example embodiment, the trigger release may also be in rotatable connection with the housing at a fourth axis 130. However, as illustrated in more detail below, the trigger release 128 may move axially (e.g., back and forth) to cause the release paw 126 to release the latch 106. Also, some example embodiments may not include a trigger release in operative connection with the housing.

Figure 2:
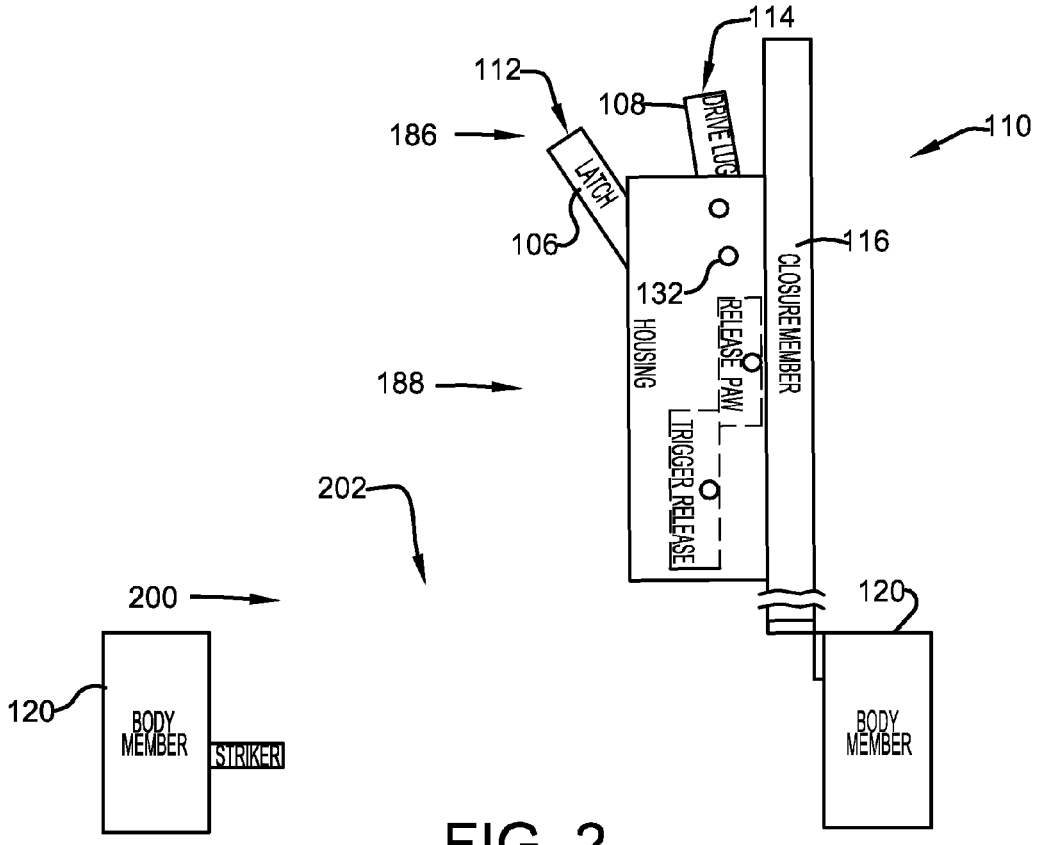

FIG. 2 illustrates the apparatus 110, in which the latch 106 has rotated to a position (with respect to the axis 132) which enables the closure element 116 to move from the closed position 100 (shown in FIG. 1) to the open position 200 (shown in FIG. 2) relative to the body member 120. In the open position 200, an opening 202 through the body member 120 is exposed, whereas in FIG. 1, the opening is blocked (at least in part) by the closure element 116.

Figure 3:
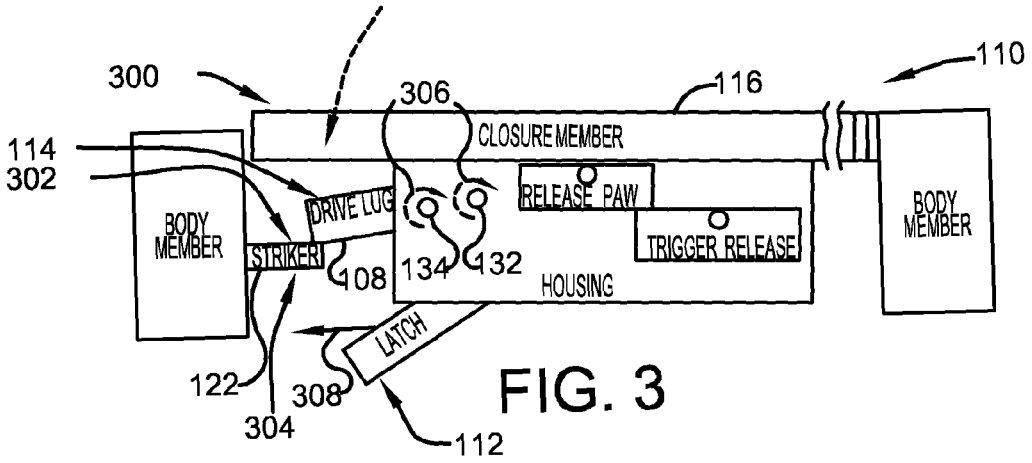

FIG. 3 illustrates the apparatus 110, in which the closure element 116 is in an intermediate position 300 in which it is being actively moved from the open position 200 depicted in FIG. 2 to the closed position 100 depicted in FIG. 1. Specifically, FIG. 3 shows the closure element 116 in a position relative to the body member 120 at the point in time when the first portion 114 of the drive lug 108 initially contacts (i.e., strikes) a first side 302 of the striker 122. Also at this depicted point in time, the first portion 112 of the latch 106 has already moved past the first side 302 of the striker to the second side 304 of the striker 122, but has not yet moved to a position relative to the second side 304 of the striker, which would prevent the closure element from moving back to the open position 200 shown in FIG. 2.

As the closure element moves from the intermediate position 300 (shown in FIG. 3) to the closed position 100 (shown in FIG. 1), the relative force of the stationary striker 122 acting on the moving drive lug 108 is operative to cause the drive lug 108 to rotate (relative to the second axis 134 through the housing) in a first rotational direction 306. As the drive lug 108 rotates in the first rotational direction 306, the drive lug is operative to cause the latch 106 to also rotate in the same first rotational direction 306 (but relative to the first axis 132 through the housing). The rotation of the latch 106 in the first rotational direction 306 is operative to cause the first portion 112 of the latch to move in transverse relation 308 relative to the striker 122 to a position in which the striker extends between the first portion 114 of the drive lug 108 and the first portion 112 of the latch 106 (as shown in FIG. 1). As discussed previously, when the latch is in the orientation shown in FIG. 1, the release paw 124 is operative to rotate to a position which engages the latch 112 and prevents the first portion 112 of the latch from moving away from the striker 122.

Also as shown in FIG. 1, it should be understood that both the first portion 112 of the latch 112 and the first portion 114 of the drive lug 108 extend in the same direction to one side of the first and second axis 132, 134. In addition, as shown in FIG. 1, the latch assembly includes opposed first 186 and second 188 areas (with the first axis 132 and the second axis 134 located between the first and second areas 186, 188). In this example, the second axis 134 of the drive lug is closer to the first area 186 than is the first axis 132 of the latch. Also, the first axis 132 of the latch is closer to the second area 188 than is the second axis 134 of the drive lug.

Also in this example, the first portion 114 of the drive lug extends in the first area 186 of the latch assembly. In addition, the first portion 112 of the latch is operable to extend into the first area 186 of the latch assembly in order to engage the striker 122 between the latch and the drive lug. Thus as shown in FIG. 1, the first portion 112 of the latch may extend farther from the second area 188 of the latch assembly than the first portion 114 of the drive lug extends from the second area 188 of the latch assembly. However, as shown in FIG. 3, when the latch 106 has rotated/pivoted away from the striker 122, the first portion 114 of the drive lug 108 extends farther from the second area 188 of the latch assembly than the first portion 112 of the latch 108 extends from the second area 188 of the latch assembly.

Another manner of expressing these features is illustrated in FIG. 1 with respect to a vector 136 that: originates from the first axis 132 (about which the latch rotates); intersects with the second axis 134 (about which the drive lug rotates); and extends outwardly and perpendicular to the second axis 134. In the example embodiment of the latch assembly, the first portion 114 of the drive lug 108 extends from the second axis 134 and the first portion 112 of the latch 106 extends from the first axis 132, both in the outward direction of the vector 136 on a side of the second axis 134 opposite the first axis 132.

Figure 4:
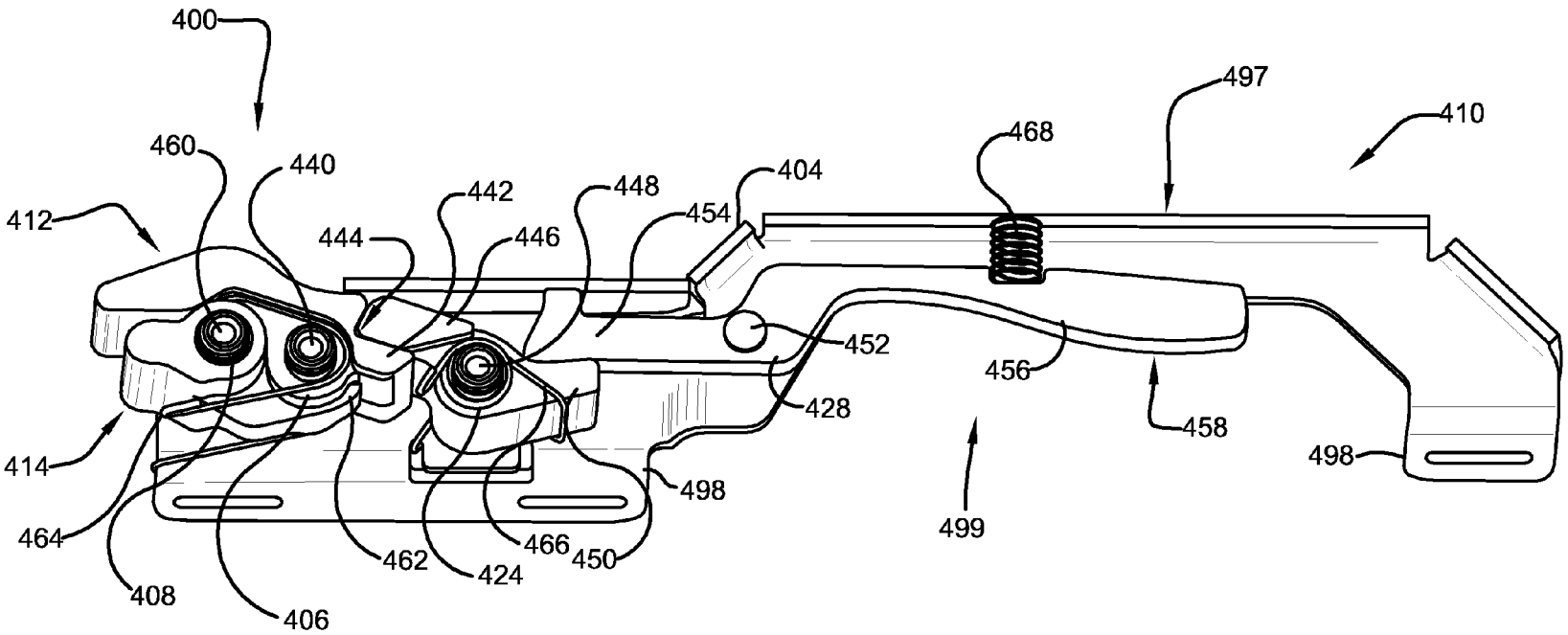
FIG. 4 is a perspective view of an example latch assembly with a side portion of the housing removed.
Figure 5:
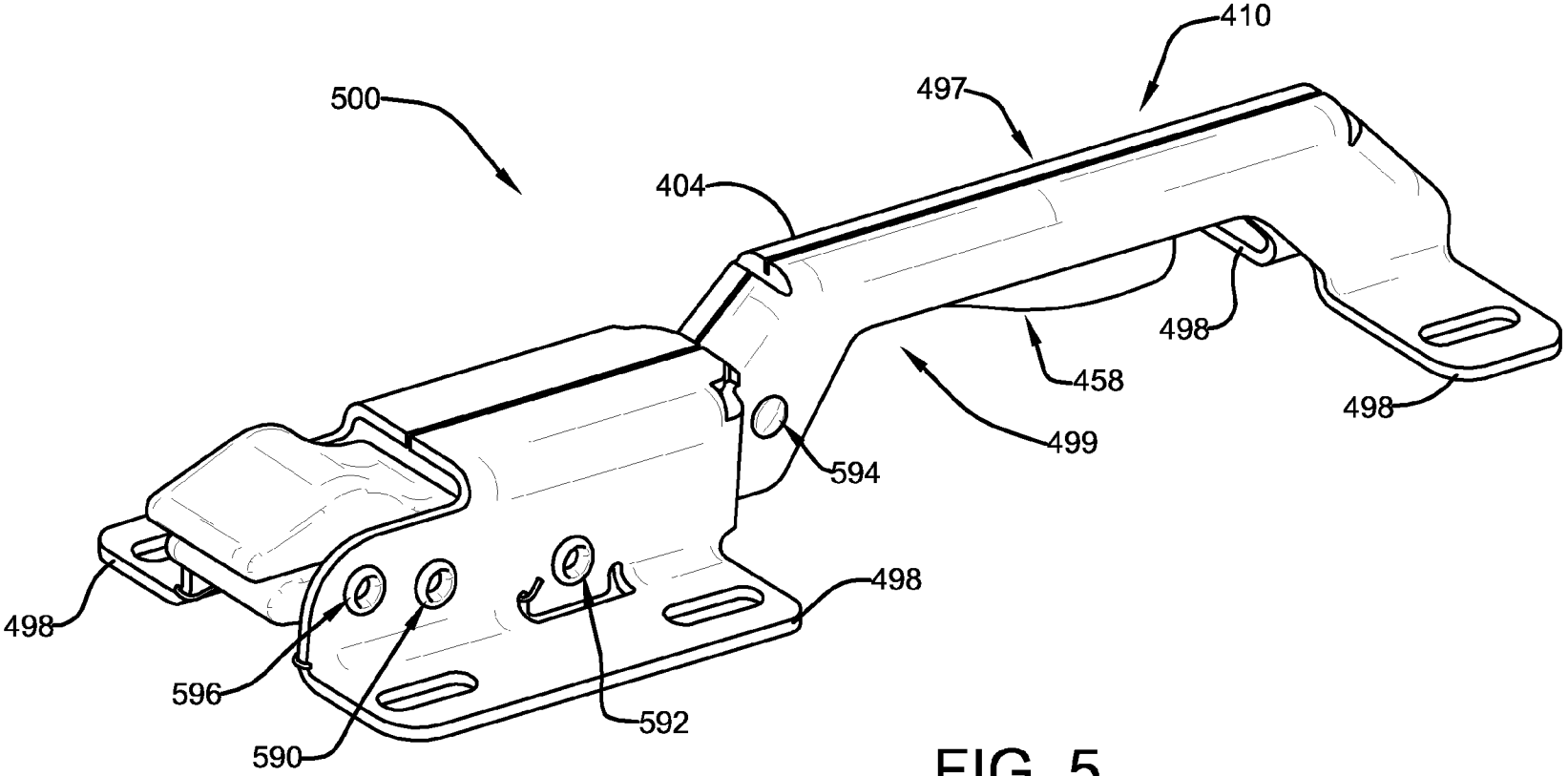
FIG. 5 is a perspective view of the latch assembly shown in FIG. 4, showing the complete housing.

FIGS. 4-10 illustrate an example embodiment of the previously described latch assembly in a form 410 adapted to be mounted to an inside surface of a closure element (e.g., a door, hatch) and which is operated by hand by moving a trigger release. FIG. 4 shows a lower side view 400 of the latch assembly 410 with a side of the housing removed. FIG. 5 shows the latch assembly 410 in a perspective view 500 with the entire housing being shown. As shown in FIG. 4, the latch assembly 410 includes a latch 406 in rotating connection with a shaft 440 that extends through and is in operative connection with the housing 404, via apertures 590 (located as shown In FIG. 5) that extend though opposed sides of the housing.

Also as shown in FIG. 4, the latch 406 includes a first portion 412 that extends on a first side of the shaft 440. The latch also includes a second portion 442 that extends on an opposite side of the shaft 442. The second portion includes a slot 444 that is operative to receive a first portion 446 of a release paw 424. In the orientation shown in FIG. 4, the first portion of the release paw is in abutting relation with the latch 406 which prevents the latch from rotating about the shaft 440.

In this example, the release paw 424 is in rotating connection with a shaft 448 that extends through and is in operative connection with the housing 404, via apertures 592 (located as shown In FIG. 5) that extend though opposed sides of the housing. In addition, the latch includes a second portion 450 that extends on an opposite side of the shaft 448 relative the first portion 446.

As shown in FIG. 4, the latch assembly 410 further includes a trigger release 428 that is in rotating connection with a shaft 452 that extends through and is in operative connection with the housing 404 via apertures 594 (located as shown In FIG. 5) that extend though opposed sides of the housing. The trigger release includes a first portion 454 that extends on a first side of the shaft 452. The trigger release 428 also includes a second portion 456 that extends on an opposite side of the shaft 452. In this example, the second portion 456 of the trigger release extends adjacent a portion of the housing 404 that serves as a handle 497. Also in this example, the trigger release includes grip surface 458 that extends outwardly of the handle 497 such that it is operative to be contacted by a user's hand and be moved relative closer to the handle 497 of the housing to cause the trigger release to rotate with respect to the shaft 452.

Also as shown in FIG. 4, the latch assembly 410 further includes a drive lug 408 that is in rotating connection with a shaft 460, that extends through and is in operative connection with the housing 404, via apertures 596 (located as shown In FIG. 5) that extend though opposed sides of the housing. The drive lug includes a first portion 414 that extends on a first side of the shaft 456. The drive lug 408 also includes a second portion 462 that extends on an opposite side of the shaft 456. In this example, the second portion 462 of the drive lug includes a curved portion that extends at least in partial surrounding relation to the shaft 440 of the latch 406, so as to be operative to engage the second end 442 of the latch 406. Also, in this example, the first portion 412 of the latch 406 is curved so as to extend at least in partial surrounding relation around portions of the drive lug that extend around the shaft 460.

As shown in FIGS. 4 and 5, the housing 404 of the example latch assembly 410 may include spaced-apart mounting brackets 498 with apertures therethrough that facilitate mounting the latch assembly to a closure member. When the brackets are mounted to a relatively planar surface of a closure member, an opening 499 between the brackets 498 is operative to provide sufficient space for a user to insert one or more fingers so as to contact the grip surface 458 of the trigger release 428.

In this described example, the shafts 440, 448, 452, 460 correspond to tubular pins about which the latch 406 rotates/pivots. However, it should be appreciated that in alternative embodiments these shafts may have different forms such as solid cylindrical pins, carriage bolts, or any other elongated structures capable of serving as a shaft. Also, in further embodiments the shafts may be made integral with the respective latch, release paw, trigger release, and drive lug and thus may rotate/pivot within the respective apertures in the housing.

This described example embodiment of the latch assembly 410 may include one or more springs 464, 466, and 468 that bias elements of the latch assembly 410 to rotate/pivot. For example, a spring 468 may be operatively positioned relative to the handle 497 of the housing 404 and trigger release 428 to urge the trigger release 428 to rotate the grip surface 458 to extend outwardly of adjacent portions of the handle 497.

Figure 6:
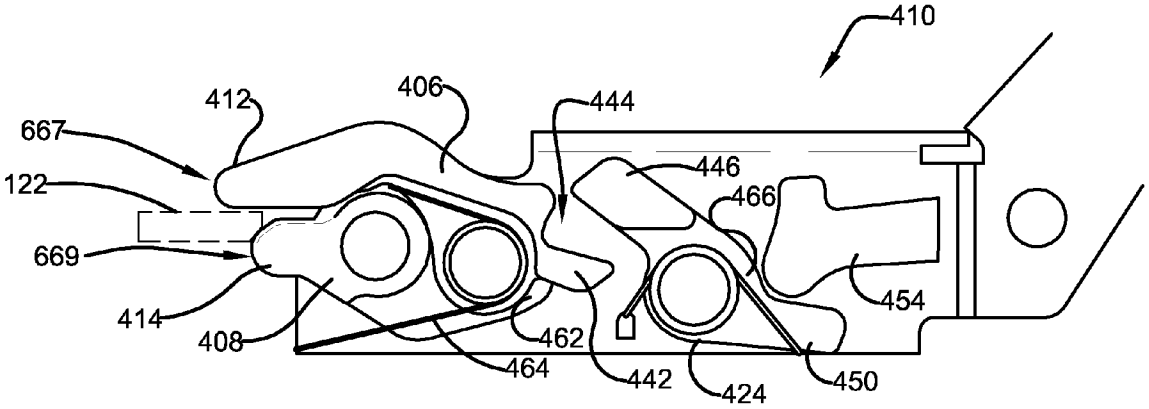
FIGS. 6-10 are cross-sectional views of the example latch assembly in different operational orientations.
Figure 7:
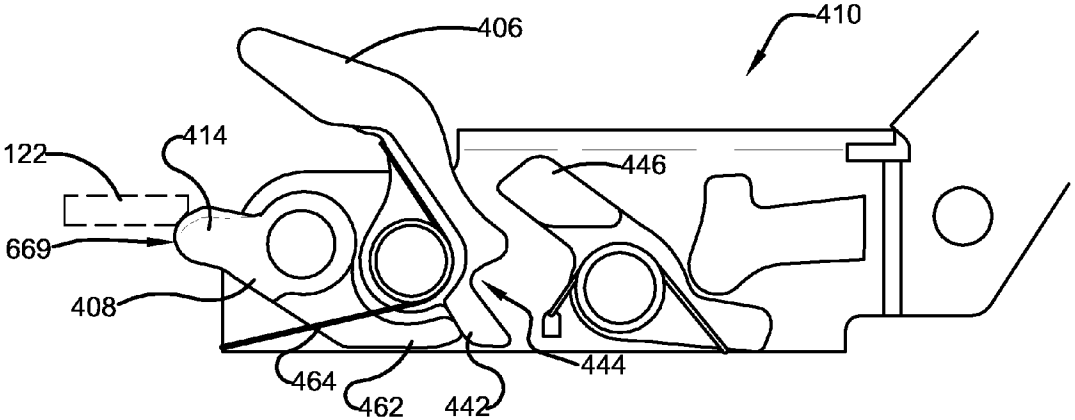

When a user squeezes the handle 497 and grip surface 458 together, the second portion 456 of the trigger release 428 is operative to pivot such that the first portion 454 of the trigger release (as shown in FIG. 6) engages and urges the second portion 450 of the release paw 424 to pivot from the first position (shown in FIG. 4) to a second position (shown in FIG. 6). As shown in FIG. 6, when the release paw 424 moves from the first position to the second position, the first portion 446 of the release paw 424 moves out of and away from the slot 444 in the second portion 442 of the latch 406. Because the first portion of the release paw 424 is no longer in abutting relation with the slot 444 of the latch 406, the latch 406 is operate to rotate/pivot from the first position (as shown in FIG. 6) to a second position (as shown in FIG. 7) responsive to the spring 464. In addition, as the latch 406 rotates/pivots from the first position to the second position, the second portion 442 of the latch is operative to urge the second portion 462 of the drive lug to cause the drive lug to rotate/pivot from the first position (as shown in FIG. 6) to a second position (as shown in FIG. 7).

In this example embodiment, it should be noted that when the latch 406 and drive lug 408 rotate from the respective first positions (shown in FIG. 6) to the respective second positions (shown in FIG. 7), the latch 408 and drive lug 408 rotate/pivot in the same rotational direction (e.g., clockwise in the views shown in FIGS. 6 and 7). In addition, as the latch 406 and drive lug 408 rotate/pivot from the respective first positions to the respective second positions, it should be noted that the area between the first portions 412, 414 of the latch and drive lug increases in size.

Further, as the latch 406 and drive lug 408 rotate/pivot from the respective first positions (shown in FIG. 6) to the respective second positions (shown in FIG. 7), it should be noted that the outward end 667 (i.e., tip) of the first portion 412 of the latch moves transversely from a position that extends farther outwardly than the outward end 669 (i.e., tip) of the drive lug (relative the housing 404) to a position in which the outward end 669 of the drive lug extends farther outwardly than the outward end 667 of the latch (relative the housing 404). As discussed previously with respect to FIGS. 1-3, movement of the latch in this manner is operative to enable the latch to move away from a striker 122, so as to permit the latch assembly (and the closure member to which it is mounted) to be moved away from the striker.

Figure 8:
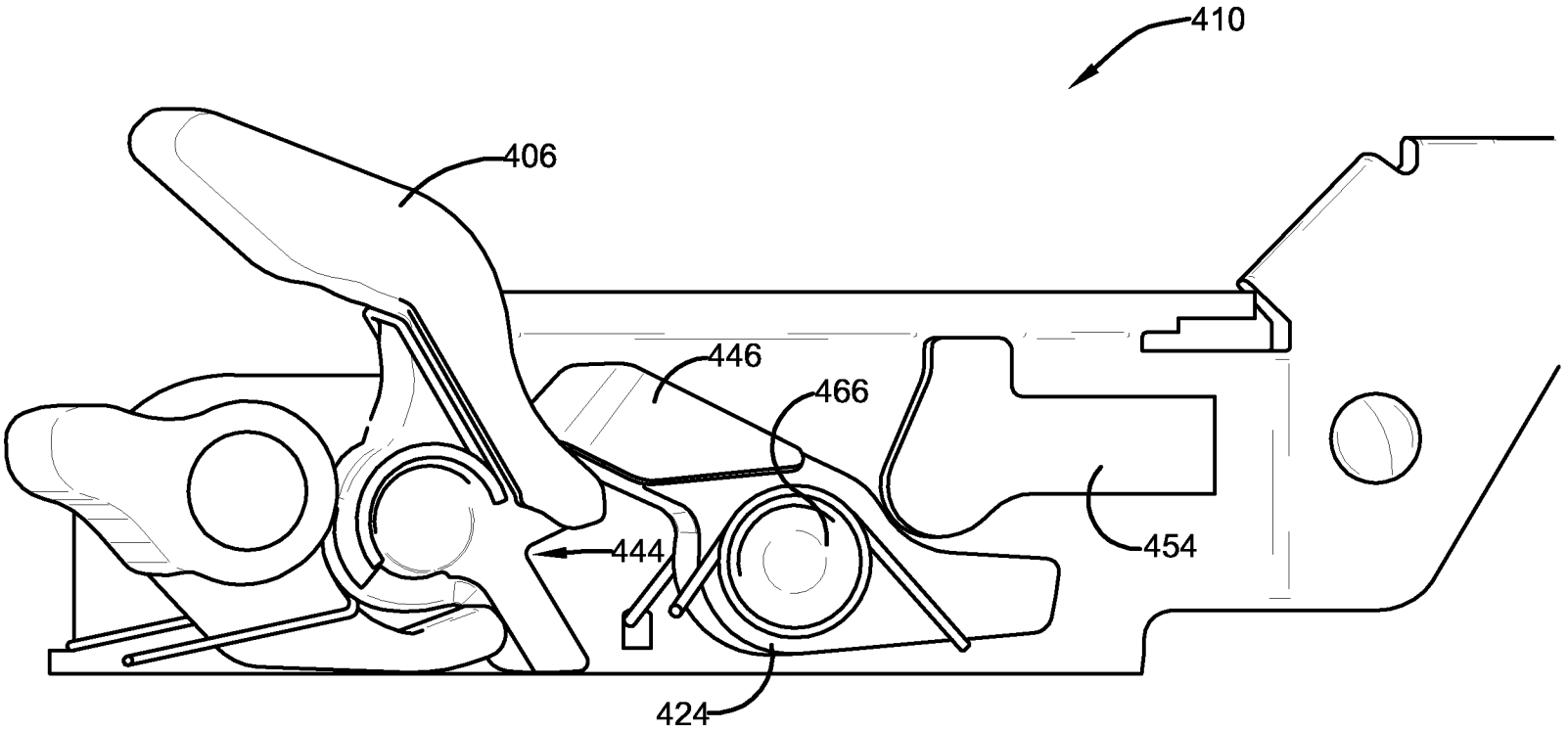

When the user of the latch assembly ceases squeezing the handle 497 and grip surface 458 together, the spring 468 (shown in FIG. 4) is operative to urge the trigger release 428 to pivot such that the first portion 454 of the trigger release moves to the position shown in FIG. 8. As the trigger release moves in this manner, the spring 466 is operative to urge the release paw 424 to rotate from the second position (as shown in FIG. 7) to an intermediate position (as shown in FIG. 8). As illustrated in FIG. 8, it should be noted that when the latch is in the second position, the first portion 446 of the release paw is unable to rotate and pivot into abutting engagement with the slot 44 of the latch 408.

Figure 9:
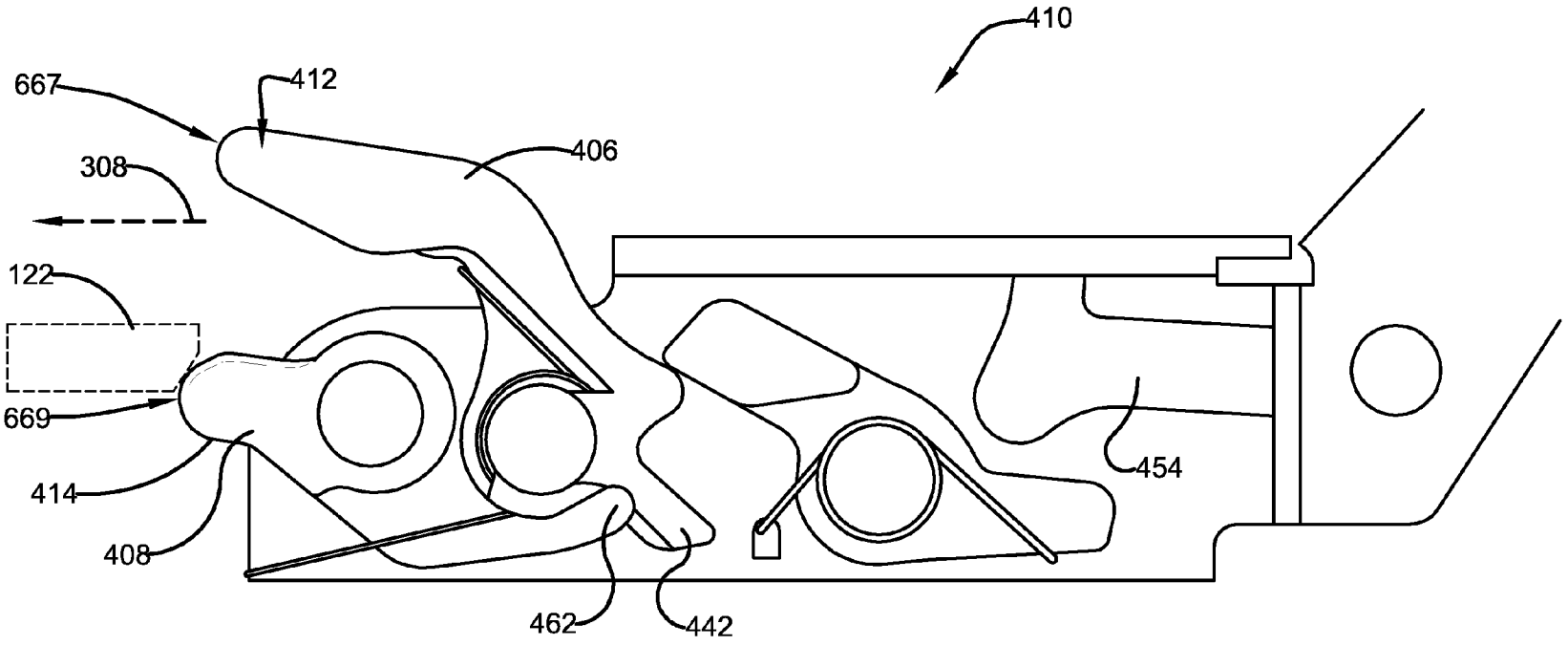

FIG. 9 illustrates the relative positions of the elements of the latch assembly 410 when the latch assembly is being moved towards a position to re-engage with the striker 122 (e.g., via closing a closure member the latch assembly is mounted thereto). Here, the forces of engagement with the drive lug 408 contacting and acting on the striker 122 are operative to cause the drive lug to rotate/pivot from the second position (shown in FIG. 8) to an intermediate position (shown in FIG. 9). As the drive lug moves in this manner, the second portion 462 of the drive lug 408 urges the second portion 442 of the latch 406 to move and cause the latch to rotate/pivot from the second position (shown in FIG. 8) to an intermediate position (shown in FIG. 9). As illustrated in FIG. 9, the outward end 667 of the latch has begun to move closer to the outward 469 of the drive lug. However, in this orientation it should be noted that the first portion 446 of the release paw is still unable to rotate and pivot into abutting engagement with the slot 444 of the latch 408.

Figure 10:
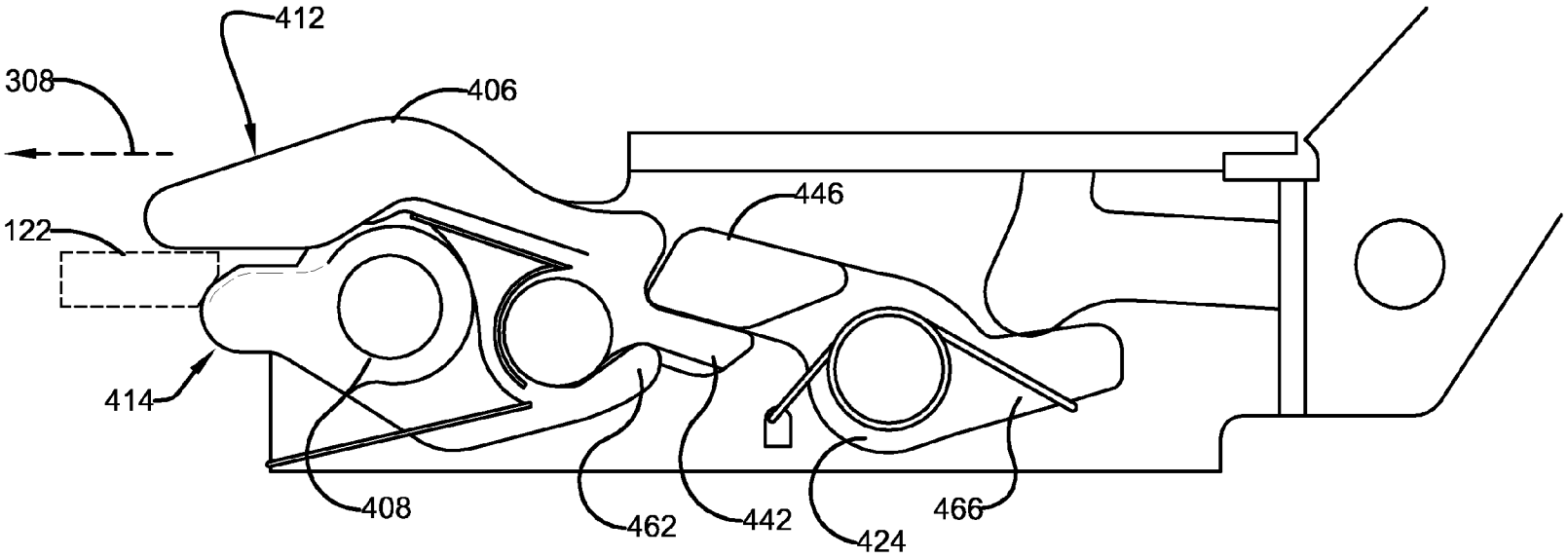

As can be appreciated, as the latch assembly continues to move, the forces of engagement with the drive lug 408 contacting and acting on the striker 122 are operative to cause the drive lug to continue rotating from the intermediate position (shown in FIG. 9) back to the first position (shown in FIG. 10). As the drive lug moves in this manner, the second portion 462 of the drive lug 408 continues to urge the second portion 442 of the latch 406 to move and cause the latch 406 to rotate/pivot from the intermediate position (shown in FIG. 9) back to the first position (shown in FIG. 10). As the latch 406 moves as shown from FIG. 9 to FIG. 10, the first portion of the latch 412 is operative to move in transverse relation 308 relative to the striker 122, to a position in which the striker extends between the first portion 414 of the drive lug 408 and the first portion 412 of the latch 406 (as shown in FIG. 10). When the latch 406 has moved back to the first position, the spring 466 is operative to urge the release paw 424 to rotate/pivot back to the first position (shown in FIG. 10) such that first portion 446 of the release paw 424 moves back into abutting engagement with the slot 444 of the latch 406 (which prevents the latch 406 and thus the whole latch assembly 410 from moving away from the striker 122).

Figure 11:
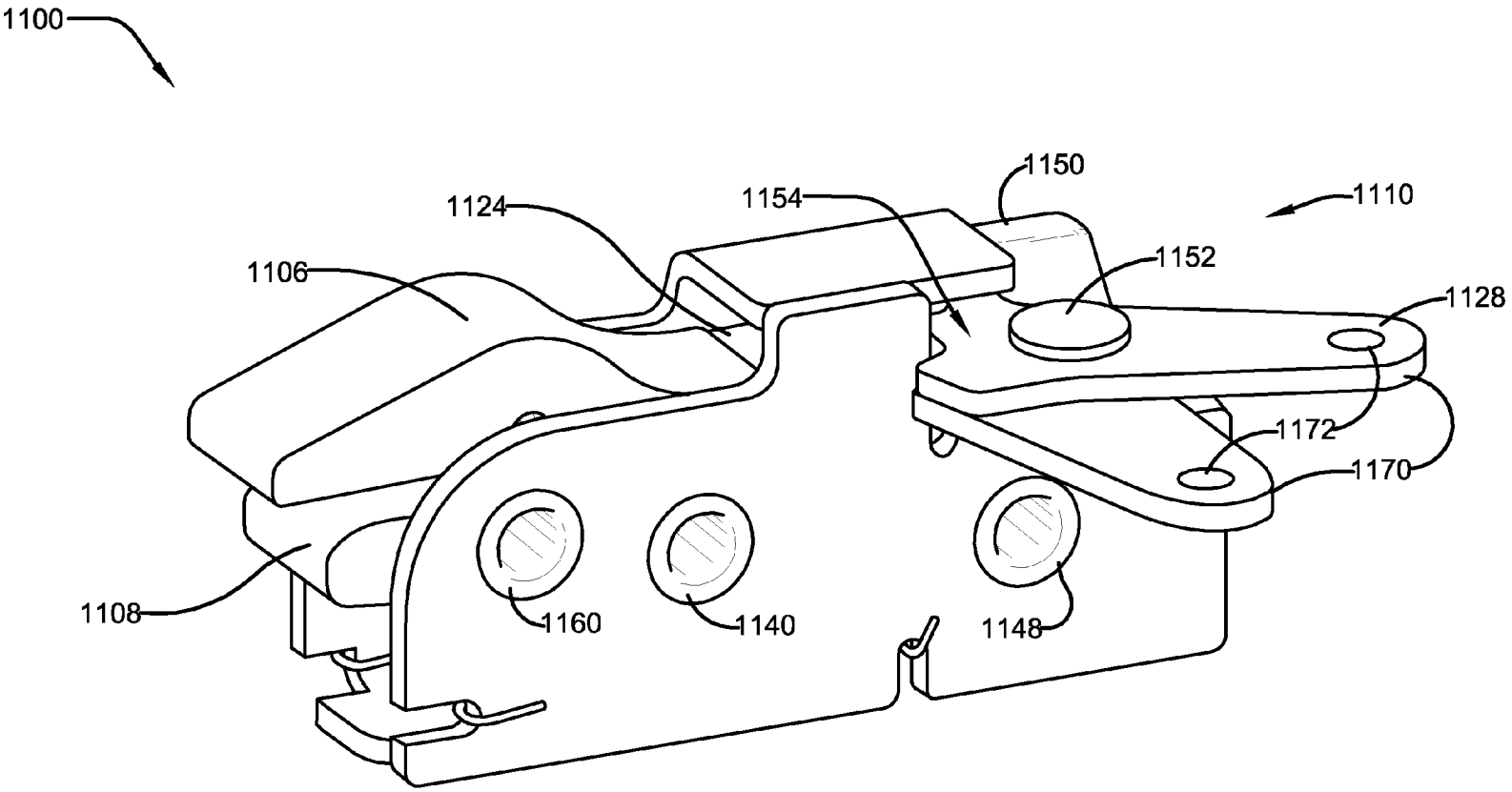
FIGS. 11-14 show examples of a further latch assembly that includes a trigger release with links.
Figure 12:
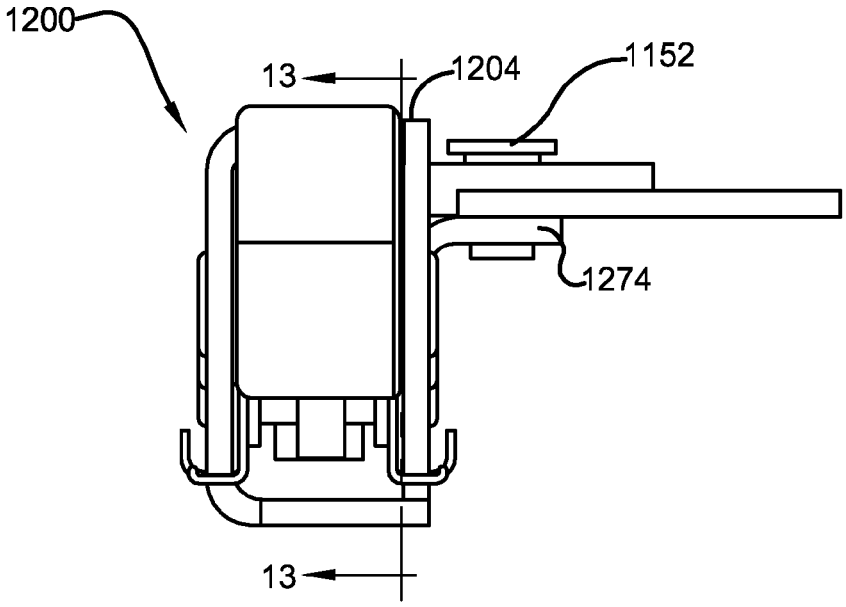
Figure 13:
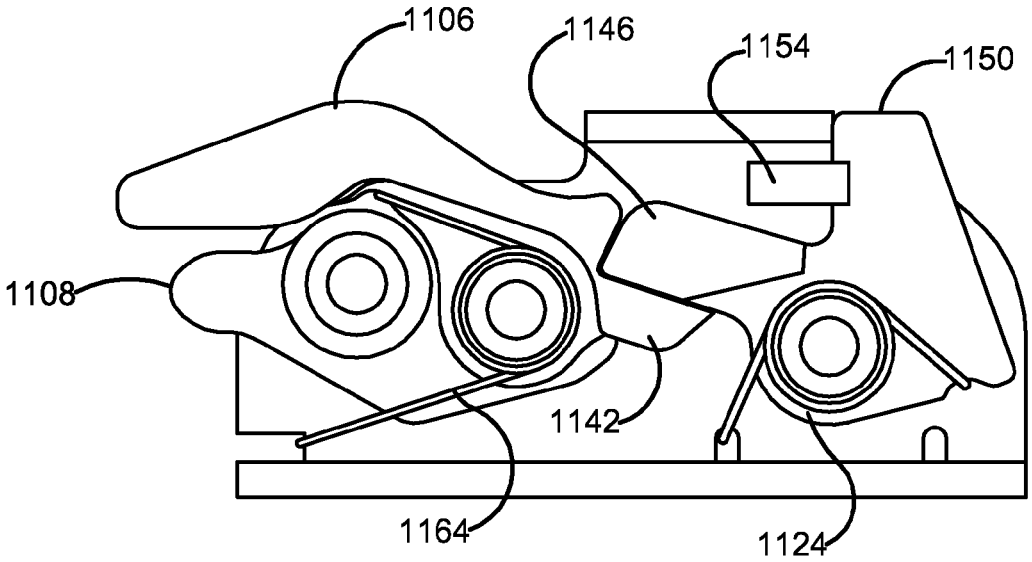
Figure 14:
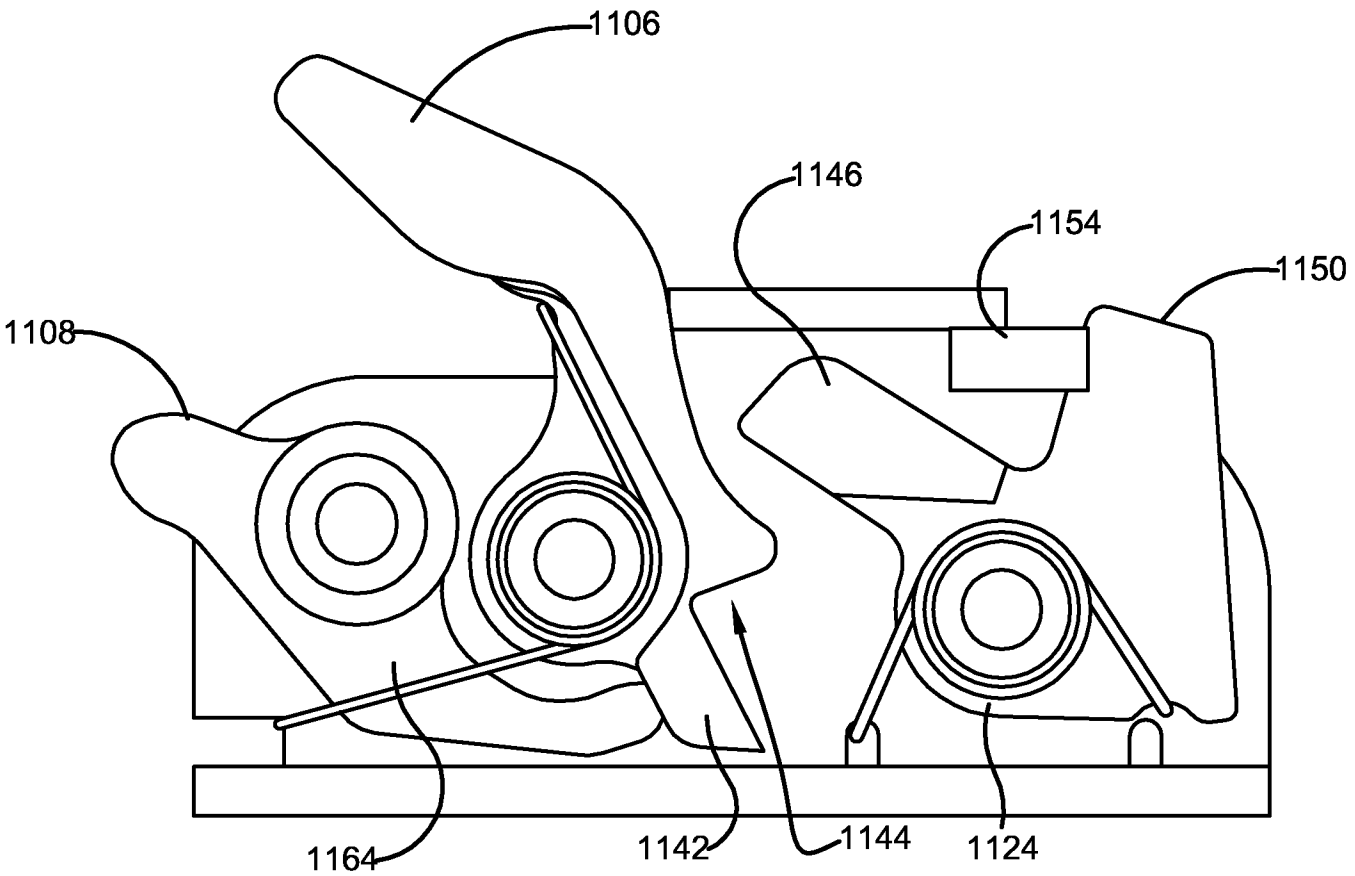

It should be appreciated that the embodiment of the latch assembly 410 illustrated in FIGS. 4-10 is one example of many possible configurations of the latch assembly. For example, rather than being configured in a manner that includes a handle surface that is squeezed by a user, FIG. 11 illustrates a perspective view 1100 of a further example latch assembly 1110 that includes a trigger release 1128 with links 1170. Such links may include holes 1172 that are operative to accommodate the connection of wires, brackets and/or other types of linkages that enable the links to be rotated/pivoted via handles, actuators and other electrical and/or mechanical devices.

As shown in FIG. 11, such links 1170 may be operative to rotate/pivot with respect to a shaft 1152 (e.g., a pin) orientated perpendicular to the orientation of the shafts 1160, 1140, 1148 for the respective drive lug 1108, latch 1106, and release paw 1124 of the example latch assembly 1110. As illustrated in the side view 1200 in FIG. 12, such a shaft 1152 may be mounted (on at least one end) to a portion 1274 of the housing 1204 that extends outwardly from a side of the housing.

As shown in FIG. 11, the trigger release 1128 may further include a first portion 1154 that is operative to contact a second portion 1150 of the release paw 1124. Rotation of the trigger release 1128 (via the links 1170) is operative to cause the first portion 1154 of the trigger release 1128 to urge the second portion 1150 of the release paw 1124 to move such that the release paw rotates/pivots from the first position shown in FIG. 13 to the second position shown in FIG. 14. As in previously described embodiments, as the release paw rotates/pivots to the second position, the first portion 1146 of the release paw moves out of the slot 1144 and out of abutting engagement with the second portion 1142 of the latch 1106. This enables a spring 1164 to urge the latch 1106 which in turn urges the drive lug 1108 to move from the respective first positions shown in FIG. 13 to the respective second positions shown in FIG. 14.

Figure 15:
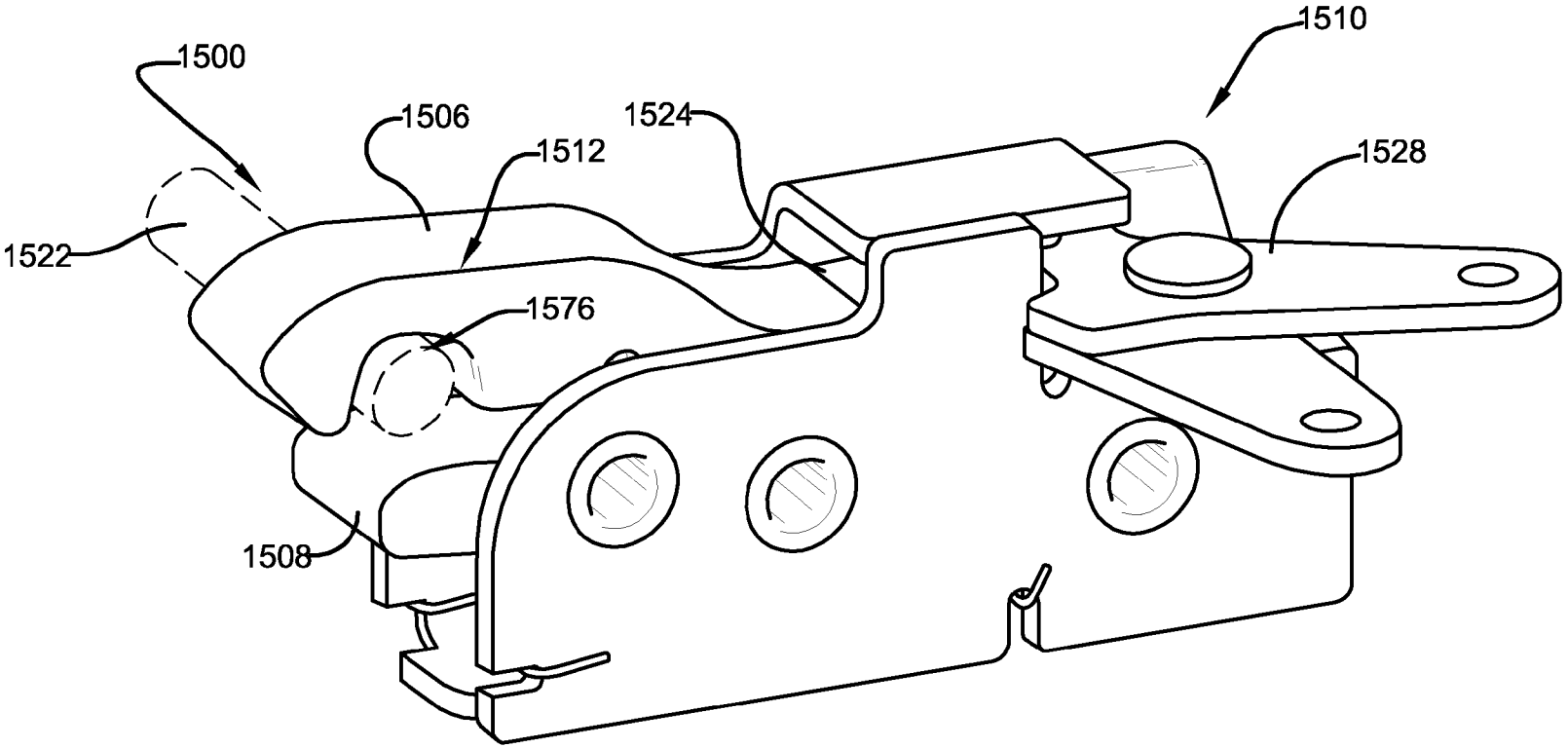
FIGS. 15-16 show examples of a further latch assembly with a latch that includes a radiused channel.
Figure 16:
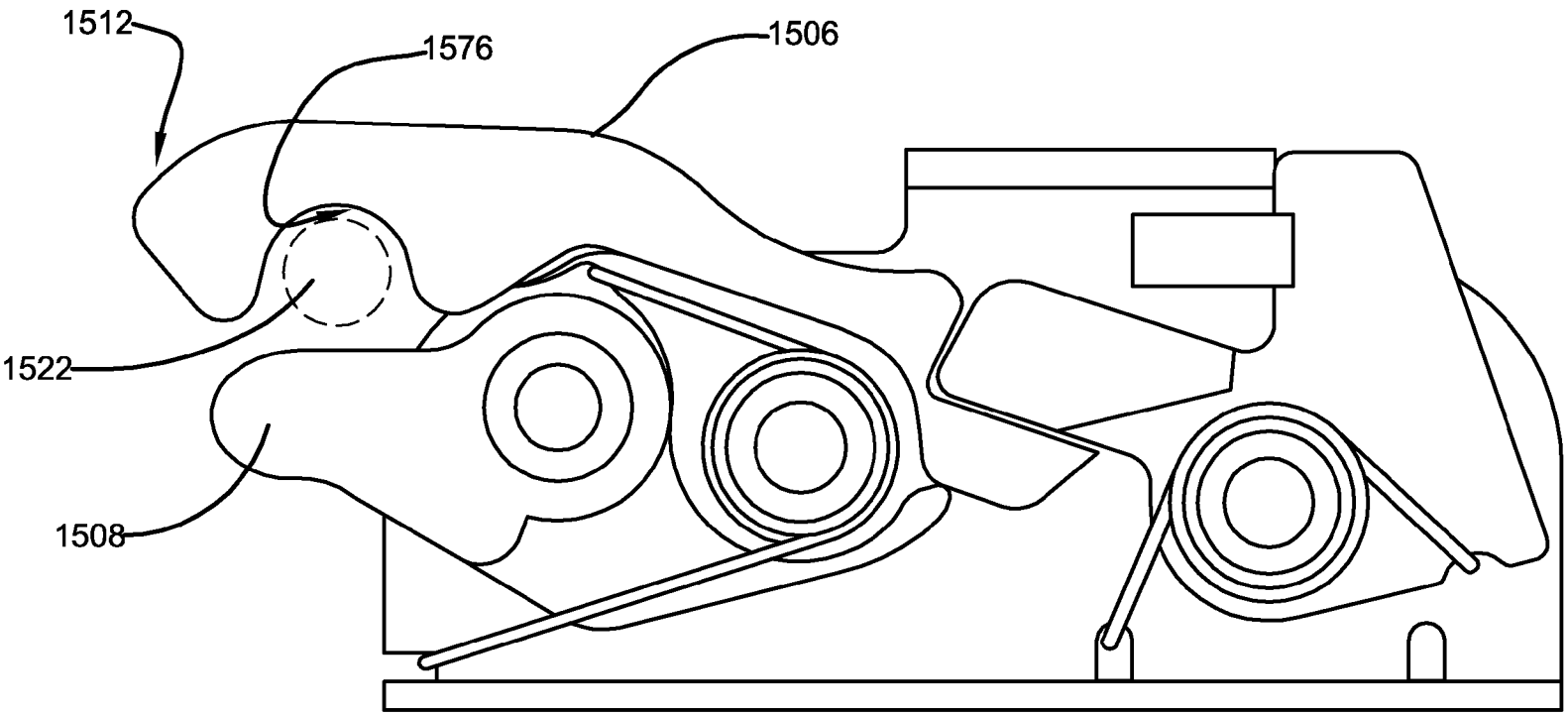

The previously described latch assemblies 410 and 1110 are operative to engage with a striker in the form of metal plate that projects from a body member (such as a door frame). However, it should be appreciated that embodiments of the described latch assemblies may be adapted for use with different sizes and types of strikers. For example, FIG. 15 illustrates a perspective view 1500 of a further example latch assembly 1510 that includes a latch 1506 that is adapted to engage a striker in the form of a cylindrical projection 1522 (e.g., a shaft, bar, bolt). As illustrated in FIGS. 15 and 16, to accommodate such a striker 1522, the first portion of the latch 1506 may include a radiused channel 1576 on a side of the first portion of the latch that faces the drive lug 1508. Such a channel 1576 may have a sufficient size to receive at least a portion a cylindrical projection 1522 therein.

In this described example, the latch assembly 1510 includes a trigger release 1528 and release paw 1524 similar to that shown in FIGS. 11-14. However, it should be appreciated that a latch 1506 with a channel 1576 therein may be used in other examples of latch assemblies described herein. Also, although the channel 1576 is shown as being radiused, it should be appreciated that in alternative embodiments, the channel may include other concave shapes such as a channel with one or more flat walls to accommodate shafts which are not cylindrical in shape.

Figure 17:
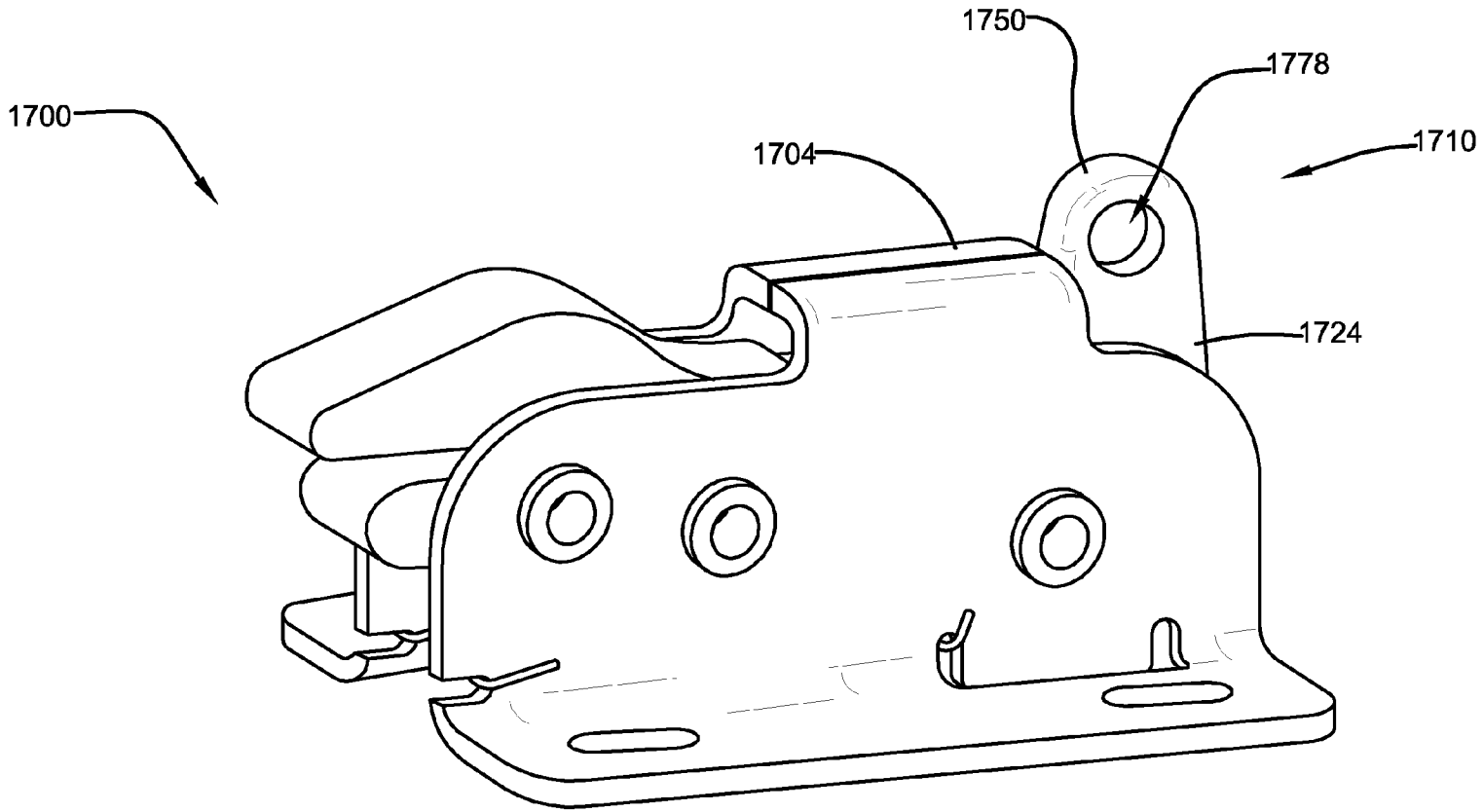
FIGS. 17-18 show examples of a further latch assembly that does not include a trigger release mounted to the housing of the latch assembly.
Figure 18:
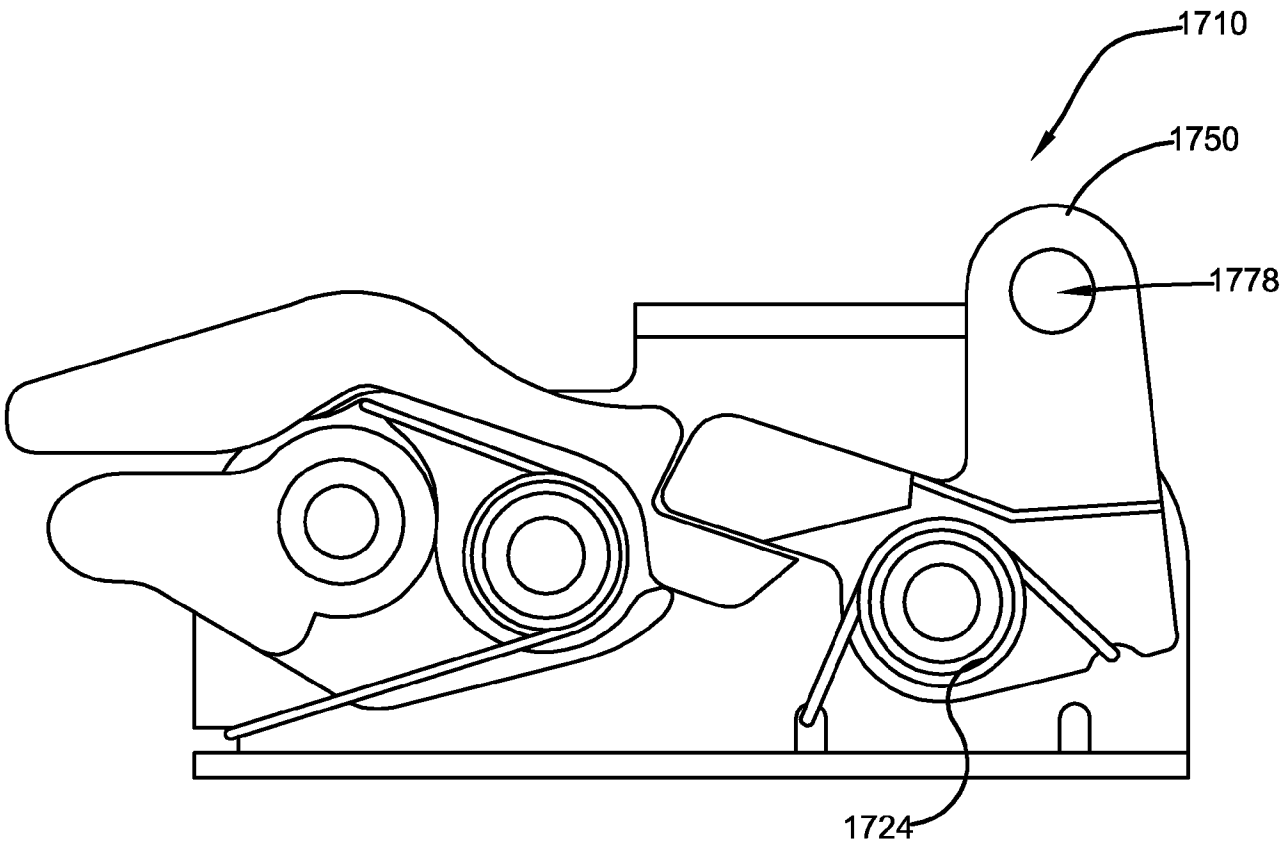

The previously described latch assemblies 410, 1110, and 1510 include trigger releases operative to urge release paws to rotate/pivot. However, it should be understood that embodiments of the described latch assemblies may be adapted to be operated without trigger releases mounted to the housing. For example, FIG. 17 illustrates a perspective view 1700 of a further example latch assembly 1710 that lacks a trigger release. FIG. 18 shows a cross-sectional view of the latch assembly 1710. In this example, instead of using a trigger release mounted to the housing 1704, the release paw 1724 of the latch assembly 1710 includes a second portion 1750 with a hole 1778 therethrough. Such a hole 1178 is operative to accommodate the connection of a wires, bracket and/or another type of linkage that enables the release paw to be rotated/pivoted via a handle, actuator and/or other electrical and/or mechanical devices.

Figure 19:
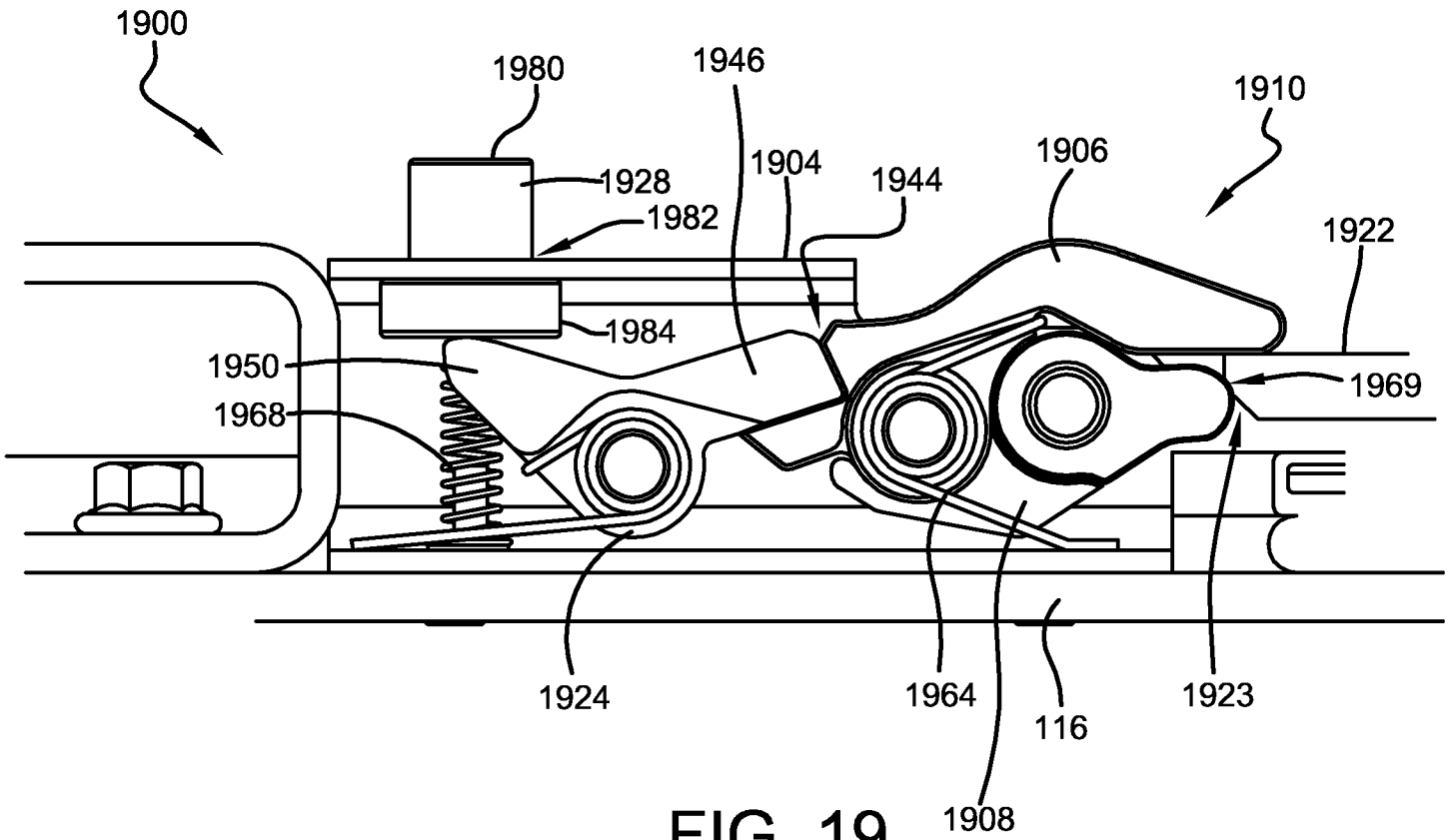
FIGS. 19-21 show examples of a further latch assembly that includes a trigger release in the form of a push button.

The previously described latch assemblies 410, 1110, and 1510 include trigger releases operative to rotate/pivot with respect to the housing of the respective latch assemblies. However, it should be appreciated that embodiments of the described latch assemblies may include trigger releases that do not rotate/pivot with respect to the housing. For example, FIG. 19 illustrates a cross-sectional view 1900 of a further example latch assembly 1910 that includes a trigger release 1928 in the form of a push button 1980. Such a push button may extend through an aperture 1982 in the housing 1904 of the latch assembly.

The push button 1980 may further include a flange 1984 having a size larger than the aperture 1982 so as to maintain the push button in engagement with the housing 1904. In addition, in this example the latch assembly may include a spring 1968 that is operative to bias the push button to extend a maximum distance from the housing 1904.

Figure 20:
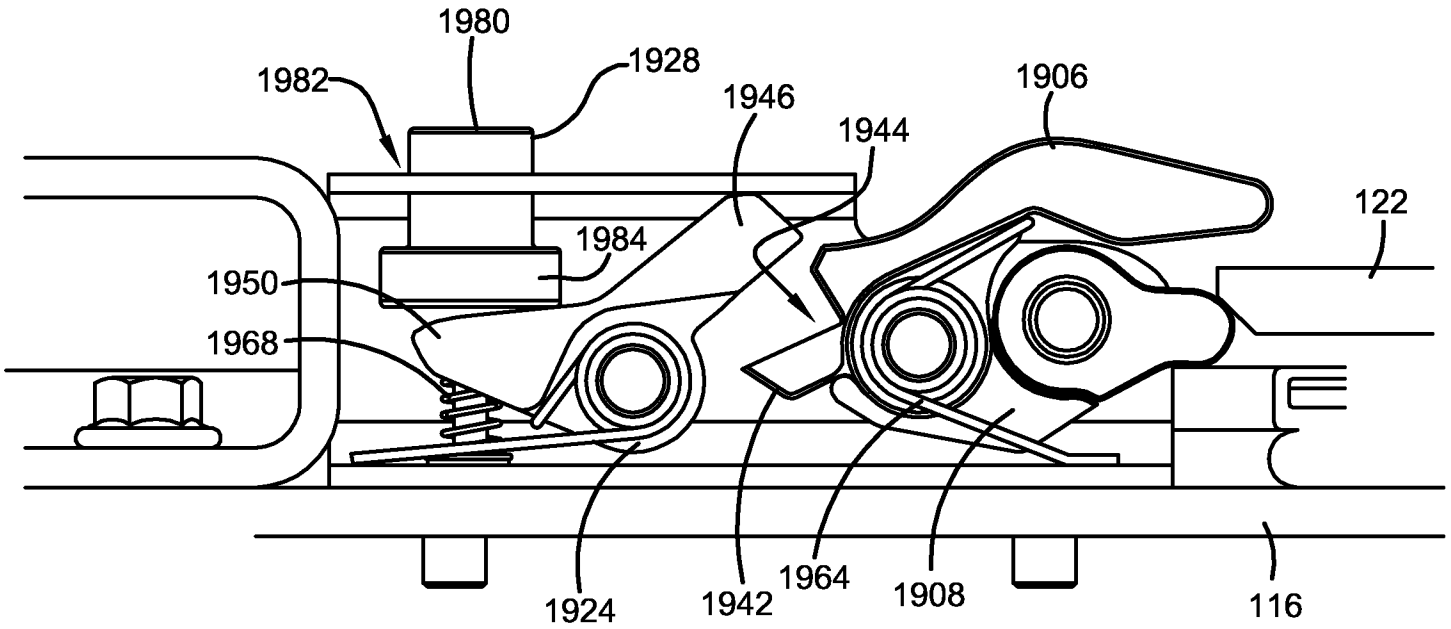
Figure 21:
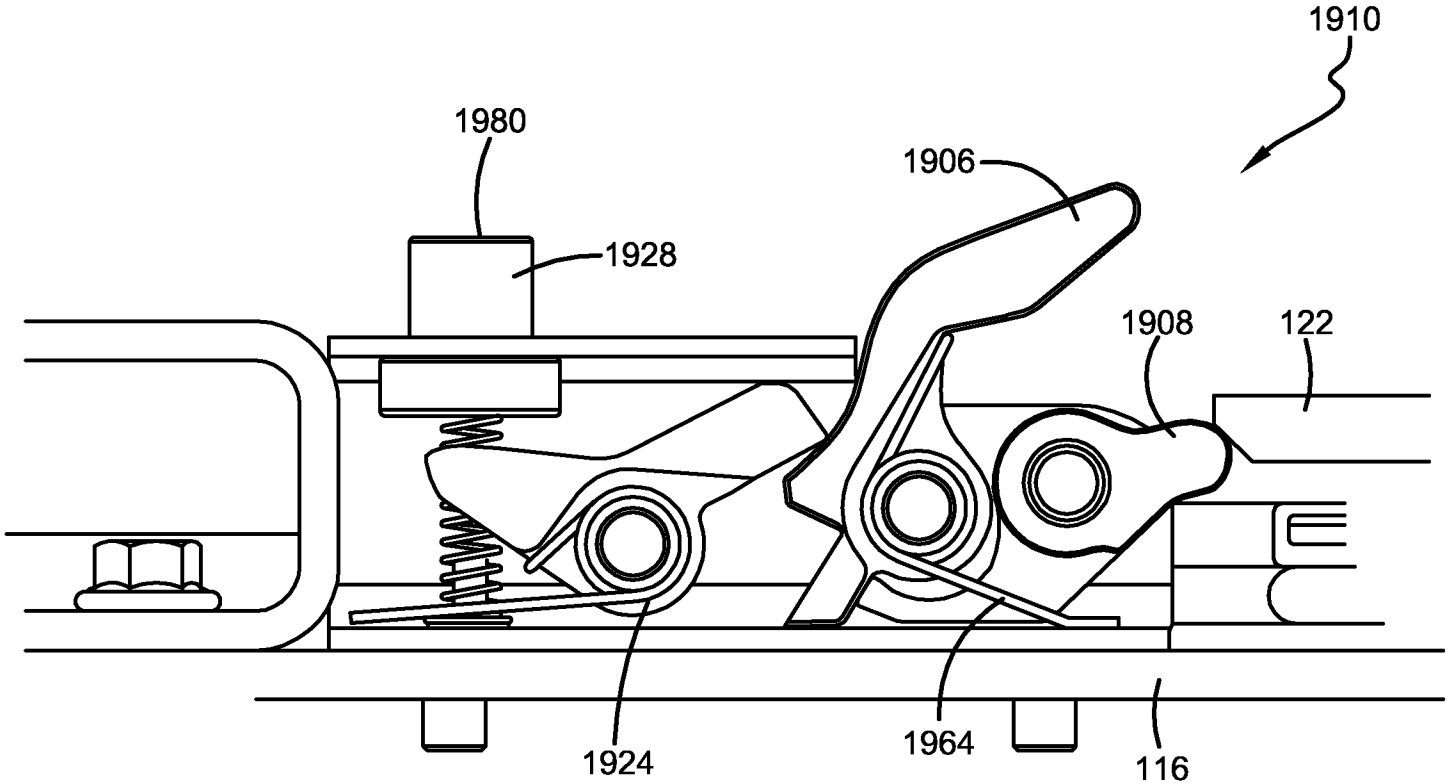

A user may push the push button 1980 towards the housing 1904 to cause the end of the push button with the flange 1984 to urge a second end 1950 of a release paw 1924 to move so as to pivot the release paw from the first position (shown in FIG. 19) to a second position (as shown in FIG. 20). As in previously described embodiments, as the release paw rotates/pivots to the second position, the first portion 1946 of the release paw 1924 moves out of the slot 1944 and out of abutting engagement with the second portion 1942 of the latch 1906. This enables a spring 1964 to urge the latch 1906 which in turn urges the drive lug 1908 to move from the respective first positions (shown in FIG. 19) to the respective second positions shown in FIG. 21 (and thereby release the latch assembly from engagement with a striker 1922.

FIG. 19 also depicts an example configuration of the striker 1922 that may be used with embodiments of the latch assemblies described herein. Such a striker 1922 may include a beveled edge 1923 that is positioned to contact the outward end 1969 of the drive lug 1908. Such a bevel may be orientated at an angle from 35 to 55 degrees with respect to front and/or back surfaces of the striker 1922. Also as shown in FIG. 19, the outward end 1969 of the drive lug that contacts the beveled edge 1923 of the striker may be radiused. In this embodiment, these described shapes and orientations of the striker and drive lug may be operative to minimize wear between the drive lug and striker. In addition, these described shapes and orientations of the striker, drive lug and latch are operative to minimize the depth of the striker that is needed to enable the latch assembly to engage the striker.

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. Apparatus comprising:

a latch assembly including:

a housing, a latch in movable operative connection with the housing and rotatable about a first axis, wherein the latch includes a first latch portion, a drive lug in movable operative connection with the housing and rotatable about a second axis, wherein the second axis is spaced from the first axis, wherein the drive lug includes a first lug portion and a further lug portion, wherein the further lug portion is operatively engageable with the latch, a release paw, wherein the release paw is movably mounted in operative connection with the housing, wherein the release paw is configured to releasably hold the latch in a position, a movable release portion, wherein the movable release portion is in operative connection with the release paw, wherein contact of the first lug portion with a striker that is moved relative to the latch assembly and perpendicular to the first axis and the second axis along a striker movement direction toward the latch assembly, is operative to cause the drive lug to rotate in a first rotational direction and the latch to rotate in the first rotational direction responsive at least in part to movement of the further lug portion, such that the first latch portion is moved transverse relative to the striker movement direction to the position, wherein the striker is holdable directly between the first lug portion and the first latch portion, wherein movement of the movable release portion is operative to enable movement of the release paw such that the latch is movable from the position.

2. The apparatus according to claim 1, wherein the latch is operative to rotate between the position which is a first rotational position and a second rotational position, wherein the drive lug is operative to rotate between a first rotational position and a second rotational position, wherein at least the first lug portion and the first latch portion are closer together when in the first rotational positions than when the latch and the drive lug are in the second rotational positions.

3. The apparatus according to claim 2, wherein with respect to a vector that: originates from the first axis; intersects with the second axis; and extends outwardly and perpendicular to the second axis, the first lug portion extends from the second axis and the first latch portion extends from the first axis, both in the outwardly direction of the vector on a side of the second axis opposite the first axis.

4. The apparatus according to claim 2, wherein the release paw is in rotatable operative connection with the housing about a third axis that is spaced apart on the housing from the first and second axes, wherein the release paw is operative to rotate between a first rotational position and a second rotational position; wherein when the release paw, latch, and drive lug are in the respective first rotational positions, the release paw is operative to prevent the latch from rotating from the first rotational position to the second rotational position; wherein when the release paw rotates from its respective first rotational position to its respective second rotational position, the release paw is operative to permit the latch to rotate from its respective first rotational position to its respective second rotational position.

5. The apparatus according to claim 4, further comprising at least one spring in operative connection with the housing, wherein the at least one spring is operative to urge the latch to move from the first rotational position to the second rotational position of the latch.

6. The apparatus according to claim 4, wherein the latch includes a second portion, wherein the first axis extends between the first portion and the second portion of the latch, wherein the further portion of the drive lug includes a curved portion; wherein in at least some of the positions of the drive lug between the first rotational position and the second rotational position, the curved portion of the drive lug is operative to extend in surrounding relation of at least a portion of the latch to enable the curved portion to operatively engage the second portion of the latch.

7. The apparatus according to claim 4, wherein the first latch portion includes a curved portion; wherein in at least some positions of the latch between the first rotational position and the second rotational position, the curved portion is operative to extend in surrounding relation around at least a portion of the drive lug.

8. The apparatus according to claim 4, further comprising a trigger release in operative connection with the housing, wherein the trigger release includes a first the movable release portion, wherein the movable release portion operative to move between a first trigger position and a second trigger position; wherein when the movable release portion is moved from the first trigger position to the second trigger position, the movable release portion is operative to cause the second portion of the release paw to rotate from the first rotational position to the second rotational position of the release paw so as to permit the latch to rotate from the first rotational position to the second rotational position of the latch.

9. The apparatus according to claim 8, wherein the trigger release is in rotatable operative connection with the housing about a fourth axis; wherein the trigger release is operative to rotate between a first rotational position and a second rotational position; wherein when the trigger release rotates from the first rotational position to the second rotational position of the trigger release, the movable release portion is operative to cause the release paw to rotate from the first rotational position to the second rotational position of the release paw so as to permit the latch to rotate from the first rotational position to the second rotational position of the latch.

10. The apparatus according to claim 9, wherein the housing includes a handle, wherein the trigger release includes the first portion and a second portion on opposite respective sides of the fourth axis; wherein the second portion of the trigger release extends adjacent the handle; wherein when the trigger release is in the first rotational position, at least a portion of the second portion of the trigger release is movable relative to the handle so as to rotate the trigger release from the first position to the second position of the trigger release.

11. The apparatus according to claim 10, wherein the housing includes at least two spaced-apart mounting brackets, wherein when the mounting brackets are configured to be mounted against a generally planar surface, the housing includes an opening between the at least two brackets and between the second portion of the trigger release and the generally planar surface.

12. The apparatus according to claim 9, further comprising a spring that acts operatively between at least a portion of the handle and the second portion of the trigger release, which spring is operative to urge the trigger release to rotate from the second rotational position to the first rotational position.

13. The apparatus according to claim 2, further comprising the striker and a closure member; wherein the striker includes opposed first and second sides, wherein the closure member is movable between a closed position and an open position relative to the striker, wherein in the closed position the closure member extends adjacent the first side of the striker and blocks an opening adjacent the striker, wherein in the open position, the closure member is spaced away from the striker and the opening adjacent the striker is externally accessible, wherein the housing is mounted in operative engagement with the closure member such that when the closure member is moved from the open position to the closed position, the first latch portion passes from a first side of the striker to the second side of the striker and the drive lug is in contact with the striker and urged thereby to rotate from the second rotational position to the first rotational position of the drive lug; wherein as the drive lug rotates to the first rotational position, the drive lug urges the latch to rotate such that the first latch portion is moved in transverse relation relative to the second side of the striker such that the striker is held between the first lug portion and the first latch portion.

14. The apparatus according to claim 13, wherein the closure member includes at least one of a door, a hatch, a hood, a trunk, and a lid.

15. The apparatus according to claim 2, wherein the latch assembly includes opposed first and second areas, wherein the first axis and the second axis are located between the first and second areas of the latch assembly, wherein the second axis is closer to the first area than the first axis, wherein the first axis is closer to the second area than the second axis, wherein the first latch portion extends in the first area of the latch assembly, wherein the first lug portion extends in the first area of the latch assembly, wherein when the latch is in the second rotational position, the first lug portion extends farther from the second area of the latch assembly than the first latch portion extends from the second area of the latch assembly, wherein when the latch is in the first rotational position, the first latch portion extends in the first area.

16. The apparatus according to claim 15, wherein when the latch is in the first rotational position, the first latch portion extends farther from the second area of the latch assembly than the first lug portion extends from the second area of the latch assembly.

17. The apparatus according to claim 1 wherein the movable release portion is in operative connection with at least one of a trigger release, a handle, an actuator, a wire or a linkage.

18. Apparatus comprising:

a latch assembly including:

a housing, a latch in rotatable operative connection with the housing and rotatable about a first axis, wherein the latch includes a first latch portion, a drive lug in rotatable operative connection with the housing and rotatable about a second axis, wherein the second axis is spaced from the first axis on the housing, and wherein the drive lug includes a first lug portion and a further lug portion angularly disposed on the drive lug from the first lug portion, a release paw, wherein the release paw is movably mounted in operative connection with the housing, wherein the release paw is configured to releasably operatively engage the latch and cause the latch to be held in a latched position, a release actuator portion, wherein the release actuator portion is movably mounted in operative connection with the housing, wherein the release actuator portion is in operative connection with the release paw, wherein rotation of the drive lug in a first rotational direction responsive to a striker that is relatively moved along a striker movement direction toward the latch assembly and is operably engaged with the first lug portion, is operative to cause the further lug portion to be in operative connection with the latch and to cause the latch to rotate in the first rotational direction to the latched position such that the first latch portion is moved transversely of the striker direction, wherein in the latched position the striker is holdable directly between the first lug portion and the first latch portion, and wherein when the latch is held in the latched position responsive to the release paw, movement of the release actuator portion is operative to enable release paw movement wherein the latch is no longer held in the latched position.

19. Apparatus comprising:

a latch assembly including:

a housing, a latch in movable operative connection with the housing and rotatable about a first axis, wherein the latch includes a first latch portion, and wherein the first latch portion includes a channel, a drive lug in movable operative connection with the housing and rotatable about a second axis, wherein the second axis is spaced from the first axis on the housing, and wherein the drive lug includes a first lug portion, wherein the latch and the drive lug are each rotatable between respective first and second rotational positions, a release paw, wherein the release paw is movably mounted in operative connection with the housing, wherein the release paw is configured to releasably cause the latch to be held in its first rotational position, a movable release portion, wherein the movable release portion is in operative connection with the release paw, wherein rotation of the drive lug in a first rotational direction responsive to operative engagement of the first lug portion with a striker when the drive lug and the latch are each in the second rotational positions, is operative to cause the latch to rotate in the first rotational direction such that the latch and the drive lug each move to their respective first rotational positions, wherein such movement causes the first latch portion to move transversely relative to the striker, the first lug portion and the first latch portion to move closer together with the striker extending directly therebetween, and the channel to extend in surrounding relation of at least a portion of the striker, and wherein the release paw is operative to cause the latch to be held in the first rotational position, wherein movement of the movable release portion is operative to enable movement of the release paw, wherein movement of the release paw enables the latch to be movable from the first rotational position.

20. Apparatus comprising:

a latch assembly, wherein the latch assembly is operative to selectively hold a striker in operatively engaged relation therewith in a latched condition, and to enable the striker to be operatively disengaged from the latch assembly in an unlatched condition, the latch assembly including:

a housing, a latch, wherein the latch is movably mounted in operative connection with the housing such that the latch is rotatable about a first axis, wherein the latch includes a first latch portion, wherein the first latch portion extends outward relative to the first axis, a drive lug, wherein the drive lug is movably mounted in operative connection with the housing such that the drive lug is rotatable about a second axis, wherein the second axis is spaced from the first axis, wherein the drive lug includes a first lug portion, wherein the first lug portion extends outward relative to the second axis, and a further lug portion, wherein the further lug portion extends outward relative to the second axis and is angularly disposed on the drive lug from the first lug portion, wherein the further lug portion is configured to operatively engage the latch, a release paw, wherein the release paw is movably mounted in operative connection with the housing, wherein the release paw is configured to operatively engage and prevent rotation of the latch in a hold position of the latch, a movable release portion, wherein the movable release portion is in operative connection with the release paw, wherein with the latch assembly in the unlatched condition, when the striker is relatively moved toward the latch assembly in a closing direction, the striker is operative to engage the first lug portion and to cause rotation of the drive lug in a first rotational direction, wherein rotation of the first drive lug in the first rotational direction is operative to cause the further portion of the drive lug to cause the latch to rotate in the first rotational direction to the hold position, wherein in the hold position of the latch, the striker is held directly between the first lug portion and the first latch portion such that the latch assembly is in the latched condition, wherein movement of the movable release portion is operative to enable movement of the release paw, wherein the latch is enabled to move from the hold position.

* * * * *